United States Patent [19]

Benasutti et al.

[11] 4,254,449

[45] Mar. 3, 1981

[54] TASK LIGHTING SYSTEM

[75] Inventors: Roger Benasutti, St. Paul; Thomas Koenig, Stillwater, both of Minn.

[73] Assignee: Conwed Corporation, St. Paul, Minn.

[21] Appl. No.: 949,761

[22] Filed: Oct. 10, 1978

Related U.S. Application Data

[63] Continuation-in-part of Ser. No. 838,764, Oct. 3, 1977, Pat. No. 4,161,767.

[51] Int. Cl.[3] ..... A61G 13/00; F21V 13/00

[52] U.S. Cl. ..... 362/33; 362/133; 362/216; 362/223; 362/225; 362/311; 362/317; 362/355

[58] Field of Search ..... 362/33, 133, 216, 217, 362/221, 222, 223, 225, 351, 355, 311, 317, 97

[56] References Cited

U.S. PATENT DOCUMENTS

| | | | |
|---|---|---|---|
| 1,514,069 | 11/1924 | Rothe | 362/33 |
| 3,375,362 | 3/1968 | Klippert | 362/33 |
| 3,712,981 | 1/1973 | Eargle | 362/216 |
| 3,802,102 | 4/1974 | Licciardi | 362/97 |
| 4,071,883 | 1/1978 | Dennis | 362/97 |

*Primary Examiner*—Monroe H. Hayes
*Attorney, Agent, or Firm*—Eyre, Mann, Lucas & Just

[57] ABSTRACT

A task lighting system for home, office or industry utilizes pairs of U-shaped fluorescent tubes at diagonal angles in a shielding enclosure supported a predetermined distance above a work surface. Veiling reflections are reduced by reducing the light output in the central region. The task lighting system may be integrated into furniture.

32 Claims, 11 Drawing Figures

TASK LIGHTING SYSTEM

BACKGROUND OF THE INVENTION

The present application is a continuation-in-part of application Ser. No. 838,764 filed Oct. 3, 1977, now U.S. Pat. No. 4,161,767.

The lighting of office work space requires either general area lighting such as overhead fluorescent or indirect lighting units or task lighting in which a light fixture is situated close to the work space and is intended to illuminate only the work space. In some situations, combinations of area lighting and task lighting are utilized. Task lighting units, for example desk lamps, are known to provide close up illumination. The applicant has discovered that the distance of the task lighting unit above the work surface is important to provide adequate lighting. If the fixture is too low, objectionable veiling reflections occur which can interfere with vision at the work space. If the fixture is too high, adequate brightness levels at the work surface with reasonable lamp sizes is not achievable. In addition, the high location of fixtures makes it difficult to shield the user's eyes from direct glare.

SUMMARY OF THE INVENTION

The present application teaches a task lighting system which may be integrated into office furniture and which significantly reduces veiling reflections. Veiling reflections arise when the angle of reflection of light from the work surface to the eye of the observer is substantially equal and opposite to the angle of incidence of light from the source to the work surface. For a specularly reflecting plane work surface, this gives rise to two offending angles of incidence, one for each eye, along which the presence of light sources would give rise to veiling reflections. Most work surfaces are diffuse rather than specular reflectors. The offending angles are thereby spread out into a generally conical offending zone centered on the defined offending angles of incidence.

The presence of substantial light sources in the offending zone provides the commonly observed phenomenon of glare, also known as veiling reflections. Veiling reflections are most intense for light sources on the offending angles and fall off trigonometrically outward therefrom at a rate which depends on the nature of the surface being viewed. As a result of veiling reflections, the observed contrast between areas of differing blackness or color on the work surface is reduced even when there is otherwise sufficient incident light on the work surface for good seeing.

A generally rectangular lamp hood closed at the top and sides and open at the bottom is positioned from about 16 to about 26 inches above a work surface such as a desk or work bench. The inner surface of the hood may be from about 15 to about 24 inches deep, from about 4 to about 6 inches thick, and from about 60 to about 96 inches wide. The width of the hood is selected to substantially match the width of the work surface, however the work surface may extend beyond the hood on one or both sides without departing from the scope of the invention. The work surface can be from about 18 to about 36 inches deep and from about 60 to about 96 inches wide. The height and placement of the hood with respect to the work surface gives good illumination with minimum veiling reflections.

Two U-shaped fluorescent tubes of a type well known in the art are mounted at an angle diagonally to the side-to-side axis of the hood. The diagonal mounting of the U-shaped fluorescent lamps further avoids veiling reflections and the use of diagonal mounting expands the allowable dimensional tolerances on the remainder of the system.

In a preferred embodiment of the invention, a unitary triangular ballast holder and lamp socket assembly occupy the center of the hood. Occupying the center as it does, the ballast holder and lamp socket assembly eliminates the center region as a source of veiling reflections. In addition, this structure permits efficient subassembly of all electrical components separately of the hood. The electrical subassembly, including the lamps if desired, may then be rapidly installed as a unit into the hood.

In a further embodiment of the invention, an opaque or translucent shield or a refractor further reduces the light emerging from the central region of the hood to reduce veiling reflections.

At least part of veiling reflections may occur due to the shift in polarization of the light as it is reflected from the work surface. This effect may be counteracted by the use of a linear polarizer at least in the central region of the hood with the axis of polarization in the front-to-back direction referenced to the work surface. A further improvement embodiment has a separate linear polarizer on each side of the centerline of the hood. The axes of polarization of the separate linear polarizers are skewed with respect to the front-to-back direction to be substantially aligned with a line between the viewer and the linear polarizer. This places the polarization of the light emerging from the hood more nearly aligned along the line of sight.

Although the preferred embodiment is employed to illuminate a substantially horizontal work surface, it is also within the contemplation of the invention that this task lighting system may be positioned to provide illumination to other types of areas. For example, illumination of machines, such as lathes, presses, etc., may be accomplished by appropriately placing this task lighting system, either suspended from overhead or the rear, or supported from below. It may also be affixed to a temporary or permanent partition.

DETAILED DESCRIPTION OF THE PREFERRED EMBODIMENT

Figure 1:
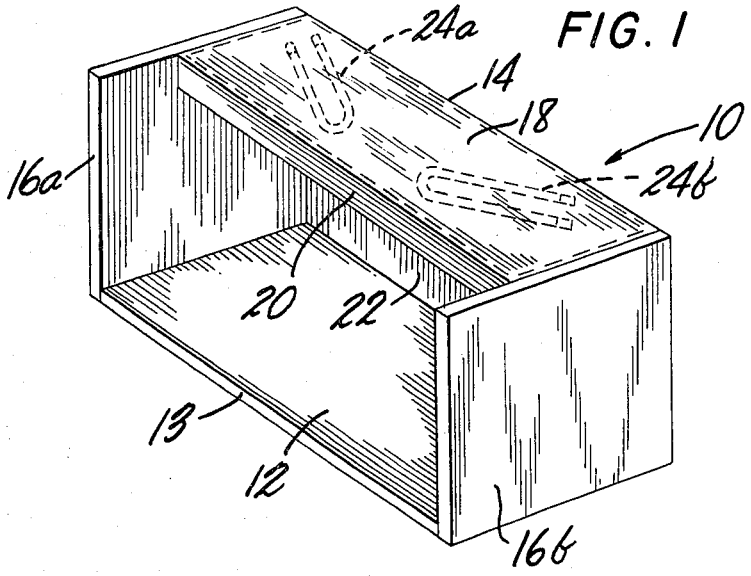
FIG. 1 shows a perspective view of a task lighting system.

Referring to FIG. 1, a task lighting system is shown generally at 10. A work surface 12, which may be a desk, work bench or other work surface has a hood 14 positioned over it. The front edge 13 of the work surface 12 is the preferred location for the worker. The hood 14 may be permanently affixed in position using end plates 16*a*, 16*b* or it may be permanently or movably suspended on legs or a cantilever member (not shown). The hood 14 has a generally horizontal flat top 18 and a front lip 20. The lip 20 forms a front edge of the hood which is generally parallel to the front edge 13 of the work surface. The front lip 20 extends downward from about 4 to about 6 inches from the flat top 18. A rear lip (not shown) of similar dimensions may be utilized at the rear of the hood 14. Alternatively, a rear wall 22 may extend downward from the hood 14 to the work surface 12. The rear edge of the hood 14 is in substantial alignment with the rear edge of the work surface 12. A first U-shaped fluorescent lamp 24*a* shown in dashed lines, diagonally positioned in the left half of the hood 14. A second U-shaped fluorescent lamp 24*b*, shown in dashed lines is correspondingly positioned in the right side of the hood 14.

Figure 2:
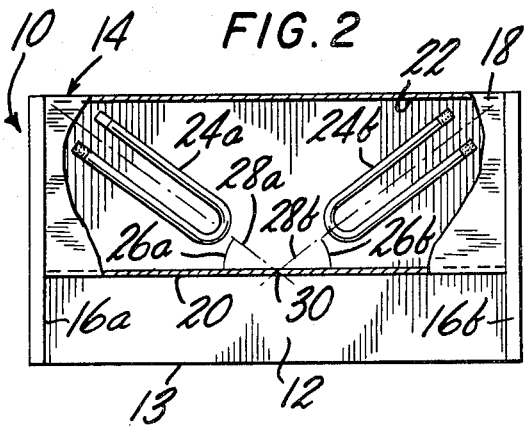
FIGS. 2–5 show arrangements of the lamps in the task lighting system.

Referring now to FIG. 2, the diagonal positioning of the U-shaped lamps is described by the angle 26*a* between a line 28*a* parallel to the axis of the legs of one of the U-shaped lamps and the front edge 30 of the hood 14. The angle 26*a* must be between 9° and 80° to prevent unwanted veiling reflections but preferably between 15° and 35° with best results obtained between 17° and 30°. The angle 26*b* defined by the line 28*b* parallel to the legs of lamp 24*b* and the front 30 of the hood should be equal to the angle 26*a*.

Figure 3:
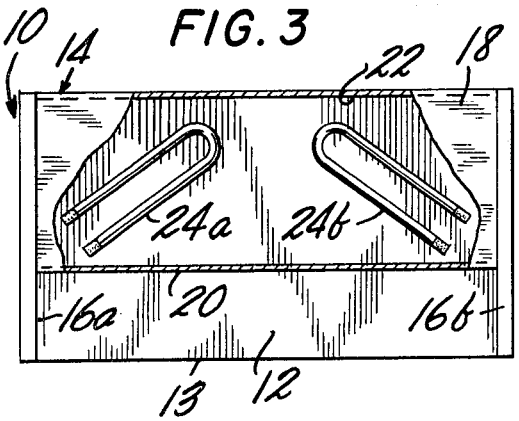
Figure 4:
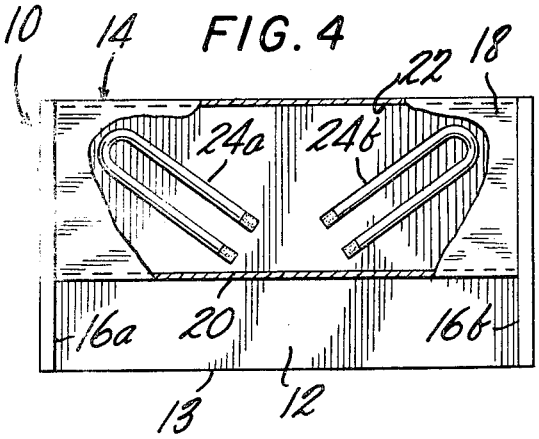
Figure 5:
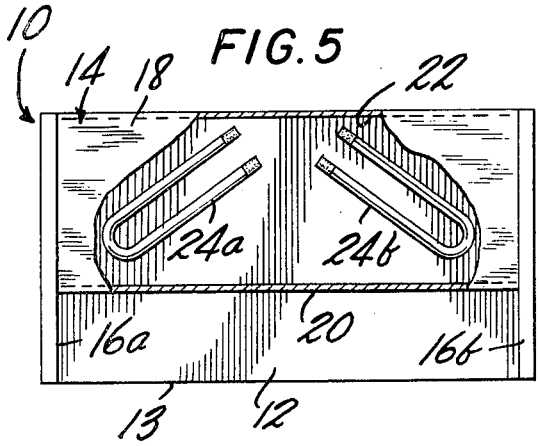

FIGS. 3, 4 and 5 show other permissible orientations of the lamps which satisfy the requirements set forth in the preceding. As shown, the closed end of the U-shaped lamps may be at the front, the rear, the outside or the inside of the hood 14 without departure from the spirit of the invention.

The embodiments shown in FIGS. 4 and 5 are preferred since the crossbars of the U are substantial emitters of light, and their location outside the offending zone near the lateral outer edges of the hood is desirable.

The embodiments shown in FIGS. 4 and 5 also permit significant convenience and economy of manufacture to be further described in connection with FIGS. 6 and 7. A generally triangular fixture comprising a unitary ballast holder and lamp socket 32, having a base wall 34 and side walls 36 with top flanges 38 forming a cavity 39 is centrally located in the hood 14 with the axis of symmetry 60 of the triangle parallel to the front-to-back direction referenced to the work surface 12. A lamp ballast 40 is conveniently located upon the base wall 34 within the cavity 39. The lamp ballast 40 is preferably fastened to the base wall 34 by conventional means not shown such as screws, rivets or cement, but may simply be placed therein without fastening. An electric power cord 42 is connected to the lamp ballast 40 and may be run directly through the rear wall 22 or may be conveniently run along the inside of the rear wall 22 supported by cord retainers 44, exiting the hood 14 through an end plate 16*a* or 16*b* and optionally terminating in an electric plug 46.

Two sockets 48 in each side wall 36 provides electrical and mechanical connection to the two mating connectors 50 at the ends of the U-shaped fluorescent lamps 24*a*, 24*b*. Wires 52 from the lamp ballast 40 are connected to the sockets 48. The outboard ends of the U-shaped fluorescent lamps 24*a*, 24*b* may be supported by clips 54 which are attached by conventional means not shown to the hood 14.

In view of the teaching of the present disclosure, it would be clear to one skilled in the art that all of the components fitting within the hood 14, including the unitary ballast holder and lamp socket 32 with all its components, and optionally with the U-shaped fluorescent lamps 24*a*, 24*b* installed, may be preassembled as a subassembly. Then, final assembly may be performed by attaching the ballast holder and lamp socket 32 to the hood 14 by means well known in the art and by attaching the clips 54. The electric power cord 42 may then be clipped into the cord retainer 44 to finish the assembly. A translucent, transparent, or optically patterned plate 56 may optionally be placed below the lamps 24*a*, 24*b* for reasons of appearance or for technical reasons to be explained later in this disclosure.

Although the offending zone shifts around with varying placement of the work being viewed and the location of the viewers head 84, for purposes of discussion, it is assumed that the portion of the work surface 12 of interest is the rectangle 58 which may represent a piece of paper or the like. If the viewers head 84 is located outside the front edge 13 of the work surface on a projection of the axis of symmetry 60 of the task lighting system 10, an offending zone 62 capable of causing veiling reflections, shown as a dashed ellipse, is set up. It is to be noted that most of the offending zone 62 and in particular the most intense central part thereof is occupied by the ballast holder and lamp socket 32. Since the ballast holder and lamp socket 32 is not itself a source of light, except for reflections, its presence in the most likely position for the offending zone 62 significantly reduces the occurrence of veiling reflections. The limited portions of the offending zone 62 which contain light-emitting parts of the fluorescent tubes 24*a*, 24*b* are located near the outer perimeter of the offending zone 62 where their contribution to veiling reflections is significantly smaller.

Figure 6:
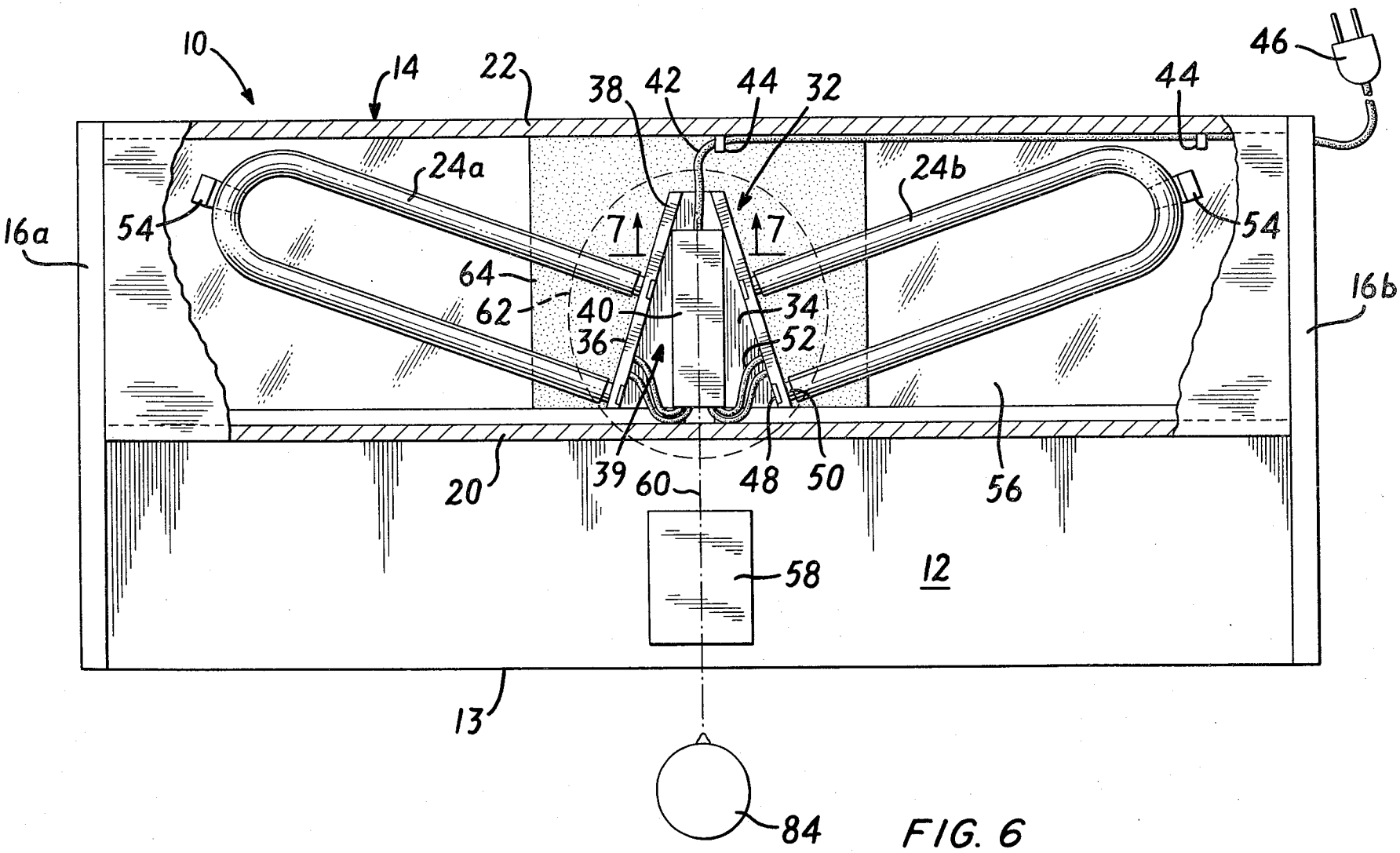
FIG. 6 shows a top view, partially cut away, of a practical embodiment of the present invention.
Figure 7:
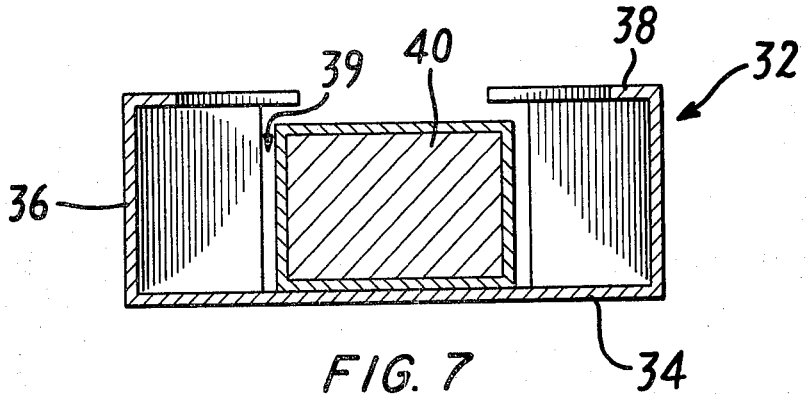
FIG. 7 shows a cross section along 7—7 of FIG. 6.

If the viewers head is moved to the right or left in FIG. 6, the offending zone 62 moves in the opposite direction, thus including more of the light-emitting parts of one of the fluorescent tubes 24*a*, 24*b*. It may therefore be desirable to screen an additional part of the central portion of the hood 14 using, for example, a screen 64. The screen 64 may be of opaque material such as a metal sheet or opaque paint on the plate 56, or it may be partially light transmitting such as a neutral density filter. The screen may extend from about 4 to about 12 inches or more each side of the axis of symmetry 60. The screen 64 may be a diffuse or specular reflector on the inside in order to direct as much as possible of the light incident on it back into the hood from whence it may be re-reflected upon the work surface from an angle outside the offending zone.

Figure 8:
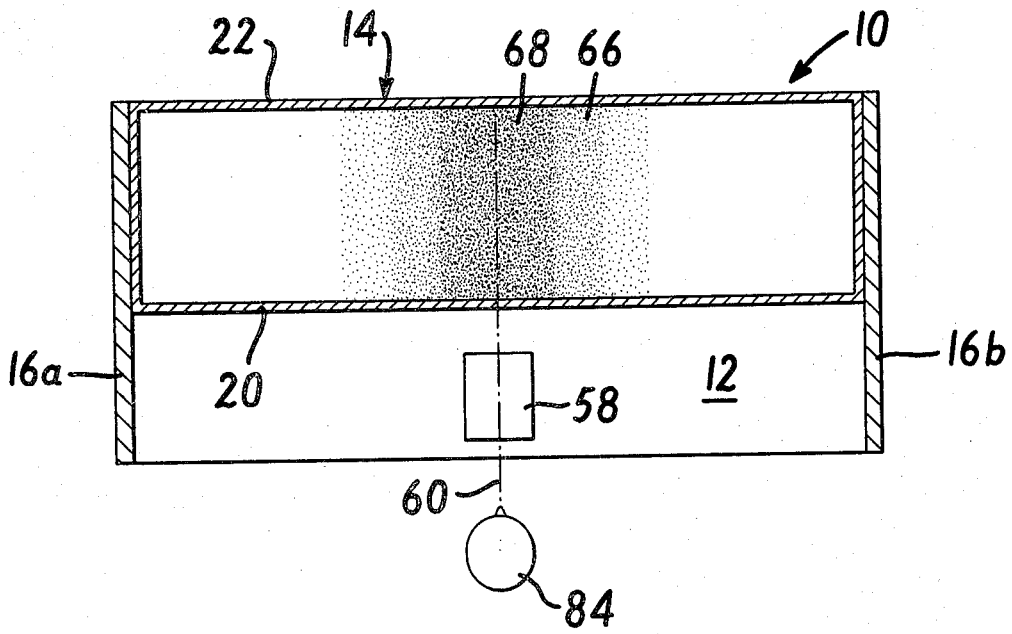
FIG. 8 shows a plan view of the invention with the top and electrical components removed to show the screen at the bottom of the hood.

Since the veiling reflections caused by a light source in the offending zone are most deleterious in the center of the offending zone and the effect falls off rapidly away from the center, a partially light transmitting continuously variable density filter 66 as shown in FIG. 8 may be employed. The continuously variable density filter 66 has a variable light transmission capability which varies with the lateral distance from the axis of symmetry 60 with the least transmission in a central zone 68 along the axis of symmetry 60 and with smoothly increasing transmission outward of the axis of symmetry to an outer region 70 on either side which is fully transparent. By varying the light-blocking ability of the screen approximately in proportion to the intensity of the veiling reflections which would occur from a typical surface due to a light source in that location, minimization of veiling reflections is achieved with the least amount of wasted light.

Figure 9:
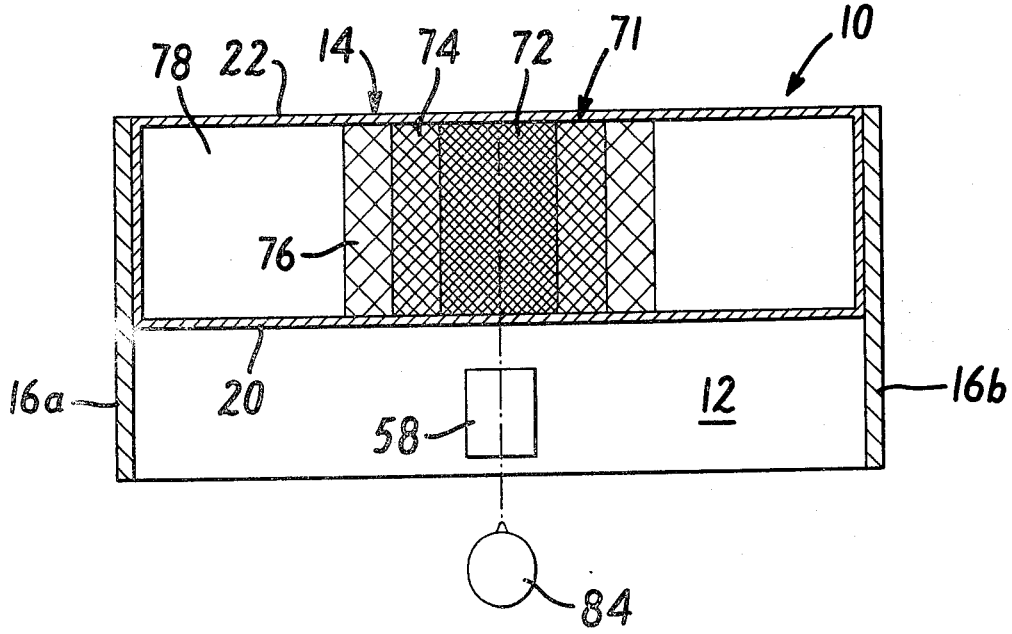
FIG. 9 shows another embodiment of a screen having stepped density.

A similar effect is achieved with the stepped-density filter 71 embodiment shown in FIG. 9. A dense filter or opaque screen 72 covers the central region of the hood 14 on either side of the axis of symmetry 60. An intermediate density filter 74 abuts each outside edge of the dense filter or opaque screen 72. A light density filter 76 abuts the outside edges of the intermediate density filter 74. Clear regions 78 abut the outside edges of the light density filters 76 and extend to the end plates 16*a*, 16*b*. The average density at any given point in the stepped density filter can be made to agree quite closely with the density at a corresponding point on continuously variable density screen shown in FIG. 8.

One advantage of using stepped density rather than continuously variable density filtering is its ease of manufacture. A stepped density filter 71 can use layers of filtering film to achieve the desired opacity. For example, the light density filter 76 may be produced by a sheet of filtering film on a plate where the sheet of filtering film also underlies or overlies the intermediate density filter 74 and dense filter 72. A second sheet of filtering film overlies or underlies the above described sheet and covers the region of the intermediate density filter 74 as well as the dense filter 72. Since this gives two layers of filtering film in the intermediate density filter 74, if the densities of the two layers are equal, the light transmission is reduced to $\frac{1}{4}$ of that in the light density filter 76. Similarly, a third layer of filtering film in the dense filter 72 reduces the light transmission to 1/9 of that in the light density filter 76.

More than three filter densities can be used of course. The more steps used, the more closely the stepped density filter 71 shown in FIG. 9 approaches the continuously variable density filter 60 shown in FIG. 8.

Figure 10:
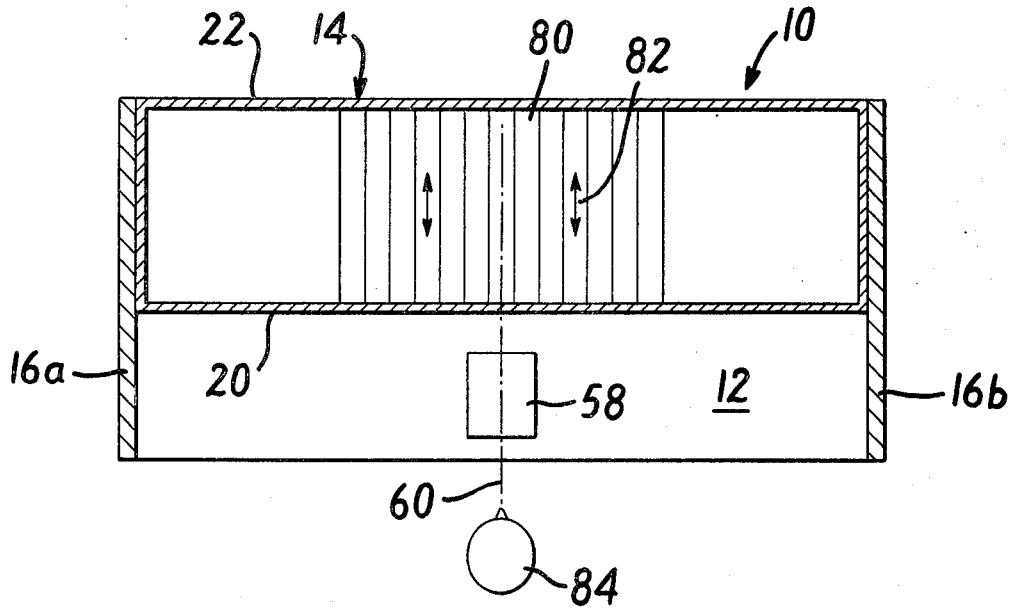
FIG. 10 shows a screen employing a linear polarizer.

It is believed that veiling reflections are at least partly due to partial linear polarization of light reflected from the work surface. This effect may be reduced as shown in FIG. 10 by employing a polarizing screen 80 spanning the central region of the hood 14. The axis of polarization of the polarizing screen 80 lies along the double-headed arrows 82. Since the light transmitted through the polarizing screen 80 along the axis of symmetry 60 toward the work surface is substantially linearly polarized perpendicular to the rectangle 58, the veiling reflections due to polarization of the reflected light parallel to the surface is substantially reduced or eliminated entirely. The polarizing screen 80 can occupy a central location as shown or can extend to the ends of the hood 14.

The closer the source-work 58-observer 84 line is parallel to the axis of polarization 82, the better the improvement from polarizing screen 80. However, when the unitary ballast holder and lamp socket 32 is used, no light is emitted along the axis of symmetry 60 or for a substantial lateral difference away from it. Consequently, there is a high probability that the actual source-work 58-observer 84 line will be skewed with respect to the axis of polarization 82. The reduction in veiling reflections is thus impaired.

Figure 11:
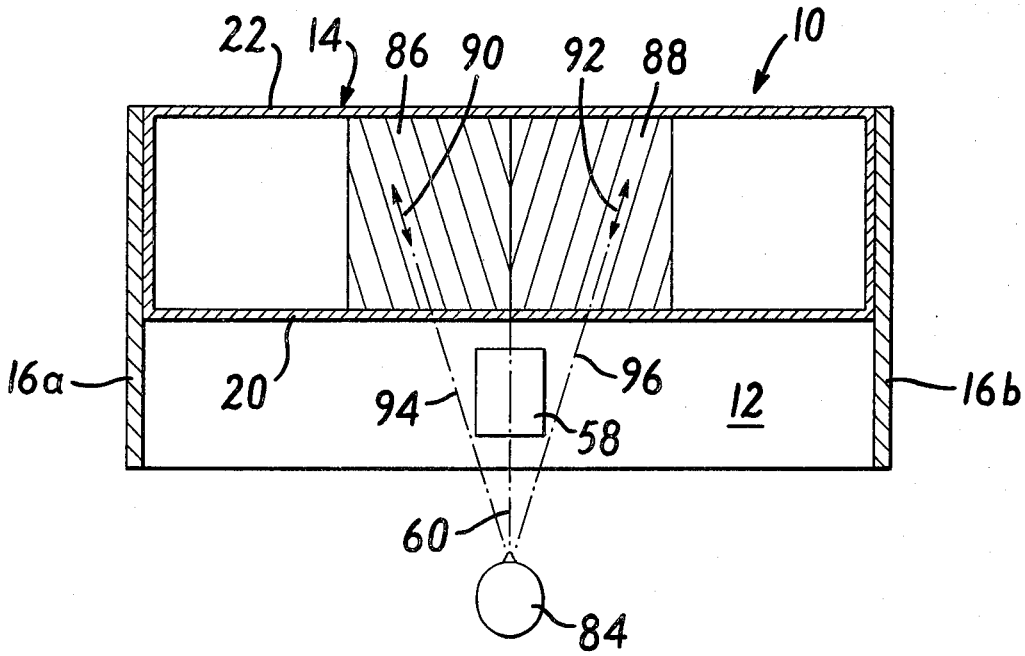
FIG. 11 shows a screen employing two linear polarizers with skewed axes of polarization.

The embodiment shown in FIG. 11 takes advantage of the fact that the center of the hood 14 is not a light source due to the presence there of the unitary ballast holder and lamp socket 32 and that the source-work 58-observer 84 line which produces veiling reflections is therefore probably skewed with respect to the axis of symmetry 60. A left linear polarizing screen 86 and a right linear polarizing screen 88 are disposed to the left and right respectively of the axis of symmetry 60. The axes of polarization 90 and 92 of the two linear polarizing screens 86, 88 respectively are skewed toward the observer 84 such that dashed lines of sight 94 and 96 from the observer 84 lie along these axes of polarization at intermediate points away from the axis of symmetry. This arrangement increases the probability that the source-work 58-observer 84 line will be parallel to or angularly very close to the axis of polarization 90 or 92 of the linear polarizing screen 86 or 88 respectively in the offending zone for the particular geometry set up by the placement of the work 58 and the position of the observer. Linear polarizing screens 86 and 88 may be overlapped in a central region, not shown, to additionally reduce the light passing therethrough due both to the partial opacity of commercially available polarizers as well as the angle between the axes of polarization which blocks light in proportion to the cosine of this angle.

In addition to totally or partially blocking the light from the central region, reduction in veiling reflections due to light sources in the region can be achieved using reflectors or refractors which permit light to exit the central region but direct it to the side or rear so that it will not be incident on the normally used area of the work surface 12.

Other types of fluorescent lamps besides U-shaped fluorescent lamps may be used in a fashion which conforms to the requirements set forth herein. A pair of straight fluorescent tubes may be substituted for the two legs of each U-shaped lamp. When the pair of tubes are disposed parallel to each other and within the range of angles specified for the legs of the U-shaped fluorescent lamp, substantially similar illumination is achieved.

The U-shaped fluorescent lamps are preferred, however, since their cost is lower than pairs of straight fluorescent tubes. In addition, the U-shaped tubes require only two sockets each rather than the four sockets required for the pair of fluorescent tubes and all four sockets can be mounted on a single fixture as shown in FIG. 6. A U-shaped fluorescent tube, satisfactory for use in the present invention, may be purchased in the United States under the designation F40/C.W./U/6. This designation indicates a fluorescent (F) lamp of 40 watts (40) with cool white color (C.W.) having a U shape (U) with the legs of the U spaced 6 inches apart on centers (6). The commercially available lamp has a tube diameter of approximately $1\frac{1}{2}$ inches and a length of 24 inches.

It will be understood that the claims are intended to cover all changes and modifications of the preferred embodiments of the invention, herein chosen for the purpose of illustration which do not constitute departures from the spirit and scope of the invention.

What is claimed is:

1. A task lighting system for illuminating a work surface comprising:

(a) a hood having a substantially horizontal top, vertically depending left and right ends, a vertically depending front edge, and a rear wall forming a conclave volume;

(b) a generally triangular fixture laterally centrally located in said hood;

(c) said fixture having first and second substantially vertical sides, said first and second sides having equal lengths and an included angle between them of from about 18 to about 160 degrees;

(d) the third side of said fixture being parallel to said front edge;

(e) at least one socket means in each of said first and second sides for holding the end of a fluorescent tube with the axis of said fluorescent tube substantially perpendicular to said side;

(f) a screen centrally located in said hood below said fluorescent tube;

(g) said screen extending from said front edge to said rear wall and laterally at least two inches each side of the center of said hood; and (h) said screen modifying the light in its area.

2. The lighting system recited in claim 1 further comprising said included angle being from about 30 to about 70 degrees.

3. The lighting system recited in claim 1 further comprising said included angle being from about 34 to about 60 degrees.

4. The lighting system recited in claim 1 further comprising:

(a) said fixture having a substantially horizontal base wall contiguous with said first and second sides;

(b) said first and second sides and said base wall forming a cavity;

(c) a ballast in said cavity; and (d) said ballast being wired to said socket means.

5. The lighting system recited in claim 1 further comprising:

(a) said at least one socket means being first and second horizontally spaced-apart sockets in said first side and third and fourth horizontally spaced-apart sockets in said second side;

(b) a first U-shaped fluorescent tube connected to said first and second sockets; and (c) a second U-shaped fluorescent tube connected to said third and fourth sockets.

6. The lighting system recited in claim 5 further comprising clips for attaching the outboard ends of said U-shaped fluorescent tubes to the underside of said top.

7. The lighting system recited in claim 1 further comprising said screen extending laterally at least 6 inches each side the center of said hood.

8. The lighting system recited in claim 1 further comprising said screen being opaque.

9. The lighting system recited in claim 1 further comprising said screen being translucent.

10. The lighting system recited in claim 1 further comprising said screen having a density which varies in proportion to the lateral distance from the center of said hood.

11. The lighting system recited in claim 10 further comprising the variation in density being continuous.

12. The lighting system recited in claim 10 further comprising the variation in density being stepped.

13. The lighting system recited in claim 1 further comprising said screen being at least one linear polarizer.

14. The lighting system recited in claim 13 further comprising the axis of polarization of said linear polarizer being parallel to an axis of symmetry of said hood.

15. The lighting system recited in claim 13 further comprising:

(a) said at least one linear polarizer being a first linear polarizer located to the left of the center of said hood and a second linear polarizer located to the right of the center of said hood; and (b) the axis of polarization of said first and second linear polarizers being skewed toward a forward projection of an axis of symmetry of said hood.

16. The lighting system recited in claim 1 wherein said screen is operative to direct the light impinging thereon in a different direction from its original direction.

17. The task lighting system of claim 1 wherein said screen comprises:

(a) a first linear polarizer on the underside of said hood extending at least two inches to the left of the center line of said hood;

(b) a second linear polarizer on the underside of said hood extending at least two inches to the right of the centerline of said hood symmetrically with said first linear polarizer; and (c) the axes of polarization of said first and second linear polarizers being symmetrically skewed toward a forward extension of the center of said hood.

18. The lighting system of claim 1 further including:

(a) a partially opaque filter laterally centrally located on the underside and extending symmetrically at least two inches to the left and right of the center of said hood; and (b) the opacity of said filter increasing from the outer edge to the center thereof.

19. The screen recited in claim 18 further comprising said opacity increasing continuously from the outer edge to the center.

20. The screen recited in claim 18 further comprising said opacity increasing in steps from the outer edge to the center.

21. The screen recited in claim 18 further comprising said opacity at each point along said filter being in relationship to the intensity of veiling reflections arising due to light emitted at said point.

22. A task lighting system for illuminating a work surface comprising:

(a) a generally rectangular concave hood;

(b) means for supporting said hood over and parallel to said work surface;

(c) first and second U-shaped fluorescent tubes in said hood;

(d) unitary means in said hood for mechanical and electrical connection to said first and second U-shaped fluorescent tubes;

(e) said unitary means being operative for symmetrically positioning said first and second U-shaped fluorescent tubes on either side of the center of said hood with the axes of said legs symmetrically disposed at an angle of from about 15 to about 35 degrees to the front edge of said hood;

(f) said unitary means being further operative to contain a lamp ballast;

(g) a screen centrally located in said hood below said fluorescent tubes, and (h) said screen modifying the light in its area.

23. A task lighting system for illuminating a work surface comprising:

(a) a hood having a substantially horizontal top;

(b) substantially vertical left and right ends, a front edge and a rear wall all depending from said top and forming a concave volume;

(c) a fixture laterally centrally located in said volume;

(d) said fixture having a substantially triangular horizontal base wall and first and second vertical sides of equal length extending upward from two sides of said triangle, said base wall and said first and second sides forming a concave upward cavity;

(e) the third side of said triangle being parallel to said front edge;

(f) first and second horizontally spaced apart sockets in said first side;

(g) third and fourth horizontally spaced apart sockets in said second side;

(h) first and second U-shaped fluorescent tubes each having first and second connectors at the ends of the legs of the U shapes;

(i) the first and second connectors of said first U-shaped fluorescent tube being connected to said first and second sockets;

(j) the axes of the legs of said first U-shaped fluorescent tube being substantially normal to said first side;

(k) the first and second connectors of said second U-shaped fluorescent tube being connected to said third and fourth sockets;

(l) the axes of the legs of said second U-shaped fluorescent tube being substantially normal to said second side;

(m) the included angle between said first and second sides being between 30 and 70 degrees;

(n) a lamp ballast in said cavity;

(o) electrical wires connecting said first, second, third and fourth sockets to said lamp ballast;

(p) an electric power cord connected to said lamp ballast (q) a screen extending between said front edge and rear wall and extending laterally symmetrically at least two inches from the center of said hood; and (r) said screen modifying the light impinging thereon.

24. The lighting system recited in claim 23 further comprising:

(a) a plate closing the bottom of said volume; and (b) said plate being at least partly transparent.

25. The lighting system recited in claim 23 further comprising:

(a) a screen extending between said front edge and rear wall and extending laterally symmetrically at least two inches from the center of said hood; and (b) said screen modifying the light impinging thereon.

26. The lighting system recited in claim 25 further comprising said modifying being totally blocking.

27. The lighting system recited in claim 25 further comprising said modifying being partially blocking.

28. The lighting system recited in claim 27 further comprising said partial blocking being greater near the center than near the outer edge of said screen.

29. The lighting system recited in claim 25 further comprising said modifying being linearly polarizing.

30. The lighting system recited in claim 29 further comprising the axis of polarization being parallel to said ends.

31. The lighting system recited in claim 29 wherein said linear polarizing is skewed in opposite directions on opposite sides of the center of said hood.

32. The lighting system recited in claim 25 further comprising said modifying being changing the direction of light away from the central region of said work surface.

* * * * *